US007993215B1

(12) United States Patent
Rentz

(10) Patent No.: US 7,993,215 B1
(45) Date of Patent: Aug. 9, 2011

(54) PRODUCING GOLF CLUBS

(75) Inventor: Marc T. Rentz, Madison Heights, VA (US)

(73) Assignee: Gregory E. Summers, Madison Heights, VA (US)

( * ) Notice: Subject to any disclaimer, the term of this patent is extended or adjusted under 35 U.S.C. 154(b) by 773 days.

(21) Appl. No.: 11/689,623

(22) Filed: Mar. 22, 2007

Related U.S. Application Data

(60) Provisional application No. 60/880,199, filed on Jan. 12, 2007, provisional application No. 60/785,262, filed on Mar. 23, 2006.

(51) Int. Cl.
*A63B 53/04* (2006.01)

(52) U.S. Cl. ..... 473/334

(58) Field of Classification Search ..... 473/324, 473/334, 335, 349
See application file for complete search history.

(56) References Cited

U.S. PATENT DOCUMENTS

| | | | |
|---|---|---|---|
| 2,652,256 | A | 9/1953 | Thomas |
| D212,890 | S | 12/1968 | Rose |
| 3,419,275 | A | 12/1968 | Winkleman |
| D234,962 | S | 4/1975 | Swash |
| D235,668 | S | 7/1975 | Swash |
| 4,147,357 | A | 4/1979 | Strop |
| 4,484,746 | A | 11/1984 | Brill |
| 4,867,457 | A | 9/1989 | Lowe |
| 4,951,949 | A | 8/1990 | Kastsenhuber |
| 4,962,932 | A | 10/1990 | Anderson |
| 5,013,041 | A | 5/1991 | Sun |
| 5,160,141 | A | 11/1992 | Crews |
| 5,297,794 | A | 3/1994 | Lu |
| 5,433,444 | A | 7/1995 | Chiuminatta et al. |
| 5,437,447 | A | 8/1995 | Rigutto |
| 5,577,968 | A | 11/1996 | Pritchett |
| 5,676,606 | A | 10/1997 | Schaeffer et al. |
| 5,683,309 | A | 11/1997 | Reimers |

(Continued)

FOREIGN PATENT DOCUMENTS

| | | |
|---|---|---|
| JP | 2004081241 | 3/2004 |

(Continued)

OTHER PUBLICATIONS

Odyssey Gold SRT Putters: White Steel 2-Ball SRT, White Steel Tri-Ball SRT, printed from http://shop.callawaygolf.com on Mar. 21, 2007, 13 pp.

(Continued)

*Primary Examiner* — Raeann Trimiew
(74) *Attorney, Agent, or Firm* — Leading-Edge Law Group, PLC

(57) ABSTRACT

A golf club head can, for example, include a striking component with a forward surface to strike golf balls and an arrow-like component, such as a stylus, behind the forward surface; a user can see the arrow-like component pointing approximately in an optimal direction for striking a ball. Also, in addition to a front part with a forward surface between its lateral ends, a club head can include two parts that extend rearward from the lateral ends and support a weight part at a distance from the forward surface. Also, to prevent twisting about a lateral center of mass when a ball is hit, the front part can include upper and lower lobe-like portions with connections at their lateral ends and with a less connected region between, such as a gap or a thin connecting portion. A hosel can be connected to the upper lobe-like portion between the end connections.

25 Claims, 10 Drawing Sheets

U.S. PATENT DOCUMENTS

| | | | | |
|---|---|---|---|---|
| 5,769,737 | A | 6/1998 | Holladay et al. | |
| 5,830,078 | A | 11/1998 | McMahan | |
| 5,899,817 | A | 5/1999 | Dunikoski | |
| 5,916,042 | A | 6/1999 | Reimers | |
| 6,015,354 | A | 1/2000 | Ahn et al. | |
| 6,068,560 | A | 5/2000 | DeLuca | |
| 6,080,070 | A | 6/2000 | Whitley | |
| 6,319,146 | B1 | 11/2001 | Mills | |
| 6,348,014 | B1 | 2/2002 | Chiu | |
| 6,379,264 | B1 | 4/2002 | Forzano | |
| 6,422,950 | B1 | 7/2002 | Whitlam | |
| 6,558,268 | B2 | 5/2003 | Tindale | |
| 6,648,772 | B2 | 11/2003 | Vincent | |
| 6,692,378 | B2 | 2/2004 | Schmoldas et al. | |
| 6,746,344 | B1 | 6/2004 | Long | |
| 6,749,523 | B1 | 6/2004 | Forzano | |
| D502,518 | S * | 3/2005 | Smart | D21/736 |
| 6,893,355 | B2 | 5/2005 | Souza et al. | |
| 6,896,625 | B2 | 5/2005 | Grace | |
| 6,923,734 | B2 | 8/2005 | Meyer | |
| 6,929,559 | B1 | 8/2005 | Grace | |
| 6,966,845 | B2 | 11/2005 | Solheim et al. | |
| D514,182 | S | 1/2006 | Olsavsky et al. | |
| 6,986,716 | B2 | 1/2006 | Lukasiewicz, Jr. et al. | |
| 6,988,955 | B2 | 1/2006 | Stoakes | |
| 6,988,956 | B2 | 1/2006 | Cover et al. | |
| 7,014,566 | B1 | 3/2006 | Norvise | |
| 7,059,971 | B1 | 6/2006 | Schmitt | |
| 7,074,132 | B1 | 7/2006 | Finn | |
| 7,121,956 | B2 | 10/2006 | Lo | |
| 7,297,073 | B2 | 11/2007 | Jung | |
| 7,341,527 | B1 | 3/2008 | Fisher | |
| 2002/0019264 | A1 | 2/2002 | Buchanan | |
| 2002/0025859 | A1 * | 2/2002 | Finn | 473/340 |
| 2002/0032075 | A1 | 3/2002 | Vatsvog | |
| 2002/0086739 | A1 | 7/2002 | Chiu | |
| 2002/0132683 | A1 | 9/2002 | Buchanan | |
| 2003/0220150 | A1 | 11/2003 | Takase | |
| 2004/0138003 | A1 * | 7/2004 | Grace | 473/334 |
| 2005/0137027 | A1 | 6/2005 | Thomas | |
| 2005/0153792 | A1 | 7/2005 | Iacullo | |
| 2005/0187028 | A1 | 8/2005 | Chang et al. | |
| 2005/0227777 | A1 | 10/2005 | Cover et al. | |
| 2006/0014590 | A1 | 1/2006 | Tao | |
| 2006/0029916 | A1 | 2/2006 | Boscha | |
| 2006/0052178 | A1 | 3/2006 | Franklin et al. | |
| 2006/0058113 | A1 | 3/2006 | Hasegawa | |
| 2006/0172822 | A1 | 8/2006 | Liang et al. | |
| 2007/0004534 | A1 | 1/2007 | Lee et al. | |
| 2007/0021230 | A1 | 1/2007 | Haack | |
| 2007/0142123 | A1 | 6/2007 | Franklin | |
| 2007/0243950 | A1 | 10/2007 | Billings | |
| 2008/0020861 | A1 | 1/2008 | Adams et al. | |

FOREIGN PATENT DOCUMENTS

| | | |
|---|---|---|
| JP | 2006255358 | 9/2006 |
| JP | 2006320493 | 11/2006 |

OTHER PUBLICATIONS

Never Compromise :: EXCHANGE, 2006, printed from http://www.exchangeputters.com on Oct. 3 and Oct. 4, 2006, 25 pp.

"Harmony Balance Putter", printed from www.amfmgolf.com website on Apr. 28, 2008, one page.

* cited by examiner

PRODUCING GOLF CLUBS

This application claims the benefit of U.S. Provisional Patent Application No. 60/785,262, filed Mar. 23, 2006, entitled "Producing Golf Clubs", and also claims the benefit of U.S. Provisional Patent Application No. 60/880,199, filed Jan. 12, 2007, entitled "Producing Golf Clubs", both of which are incorporated herein by reference in their entireties.

BACKGROUND OF THE INVENTION

The present invention relates generally to golf techniques.

Many golf clubs have been proposed, including various clubs designed for putting. Exemplary features of various golf clubs are described, for example, in U.S. Pat. Nos. Des. 212,890; 4,484,746; 4,867,457; 5,433,444; 6,319,146; 6,746,344; 6,988,956; and 7,059,971 and in U.S. Patent Application Publication Nos. 2002/0032075; 2005/0137027; and 2006/0052178.

It would be advantageous to have improved techniques relating to golf clubs.

SUMMARY OF THE INVENTION

The invention provides various exemplary embodiments, including structures, articles, products, and methods. In general, the embodiments are implemented in relation to production of golf clubs.

Exemplary embodiments of the invention are described below with reference to the accompanying drawings.

DETAILED DESCRIPTION

Figure 1:
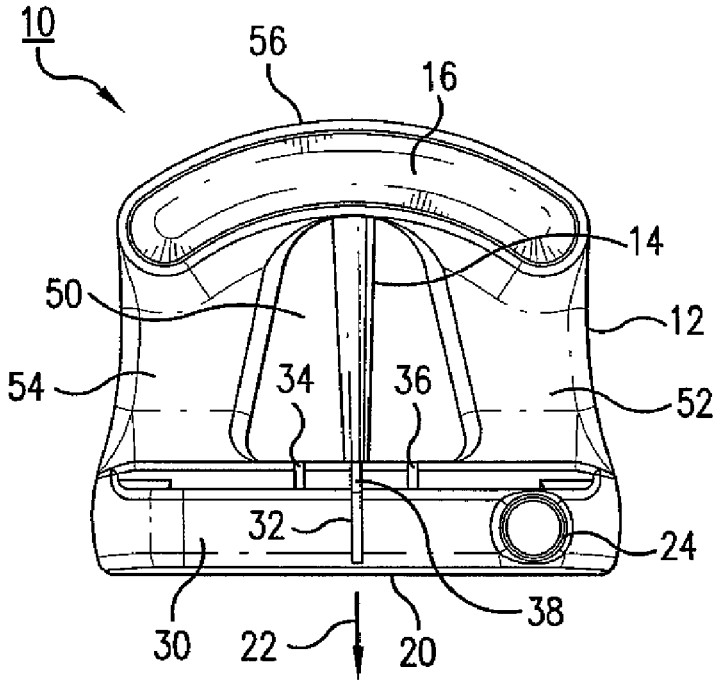
FIG. 1 is a top plan view of a golf club head assembly with a stylus.

In the following detailed description, numeric values and ranges are provided for various aspects of the implementations described. These values and ranges are to be treated as examples only, and are not intended to limit the scope of the claims. In addition, a number of materials are identified as suitable for various facets of the implementations. These materials are to be treated as exemplary, and are not intended to limit the scope of the claims.

The term "golf club" is used herein to mean a device used to hit a ball in playing the game of golf. Many types of golf clubs have been developed, including various "putters", meaning specialized golf clubs for putting, i.e. hitting a golf ball so that it rolls across the ground, such as onto or across a green around a hole. A typical golf club includes a "head" that hits a ball and a "shaft" that is connected to the head and that is held by a golfer when swinging the club so that the head hits the ball. A part at which a shaft is connected to a head is typically referred to as a "hosel".

The implementations described below address problems that arise with previous golf clubs, and specifically putters. One problem is that a golfer may incorrectly align the head with a ball so that the ball does not move as desired after being hit or struck. Another problem is that the result of hitting or striking the ball is suboptimal due to a club's structure.

In general, the implementations described below involve combinations of parts or components. As used herein, an "assembly" is a combination of two or more connected parts or components that together can function as a whole. One component of an assembly can, for example, be a "striking component", meaning a component that can hit or strike something. Other parts or components can perform other functions, such as a "connecting part" that connects other parts or components or a "weight part" or a "weight component" that functions to provide weight at a given position or set of positions. Other parts or components may be identified by other characteristics, such as an "arrow-like component" that extends in a lengthwise direction and that is shaped or otherwise structured or finished so that it directs one's attention in one orientation in the lengthwise direction. Similarly, a "front part" is a part that includes the front of an assembly; a "laterally extending part" is a part that extends in a lateral direction; and a "layered part" is a part that includes one or more layers of material.

In the implementations described below, parts or components of assemblies are sometimes referred to as "attached" to each other or to other parts or components or vice versa, and operations are performed that "attach" parts or components to each other or to other things or vice versa; the terms "attached", "attach", and related terms refer to any type of connecting that could be performed in the context. One type of attaching is "mounting", which occurs when a first part or component is attached to a second part or component that functions as a support for the first. Similarly, "fastening" occurs when a part or component attaches two or more other parts or components to each other; for example, mated external and internal threading or other frictional connections could "fasten" two components to each other. In contrast, the more generic term "connecting" includes not only "attaching", "mounting", and "fastening", but also making other types of connections such as between or among parts formed as a single piece of material by molding or other fabrication, in which case connected parts are sometimes referred to as "integrally formed". Parts or components are referred to herein as "removably connected", "removably mounted", or the like if at least one of the parts or components can be removed from the others without causing damage to the others; the part or component that can be removed may be described, for example, as removably connected to or removably mounted on one or more of the other parts or components.

A combination of one or more parts connected in any way is sometimes referred to herein as a "structure". Similarly to a component, a structure may be described by its function, such as a "handle structure" that can operate as a handle, a "support structure" that can operate as a support, a "weight structure" that includes at least one part or component that serves as a weight, or a "fastening structure" that can fasten or be fastened. Some structures are also described by structural features. For example, a "yoke-like structure" or "yoke-like part" is a structure that, like a yoke, extends between two ends at which it is connected to another structure, component, or part.

FIGS. 1-4 show several views of golf club head assembly 10 with the same reference numerals being used in each view. Assembly 10 includes frame 12 with stylus 14 and weight 16 connected to it. Assembly 10 can be attached to a shaft to produce a golf club such as a putter. The surface lines or arcs on frame 12 in each view illustrate how the outer surface of frame 12 could be divided into smaller surfaces; the divisions are intended to be the same in all views. FIG. 1 shows a top view, FIG. 2 a front view, FIG. 3 a side view, and FIG. 4 a rear view.

Figure 2:
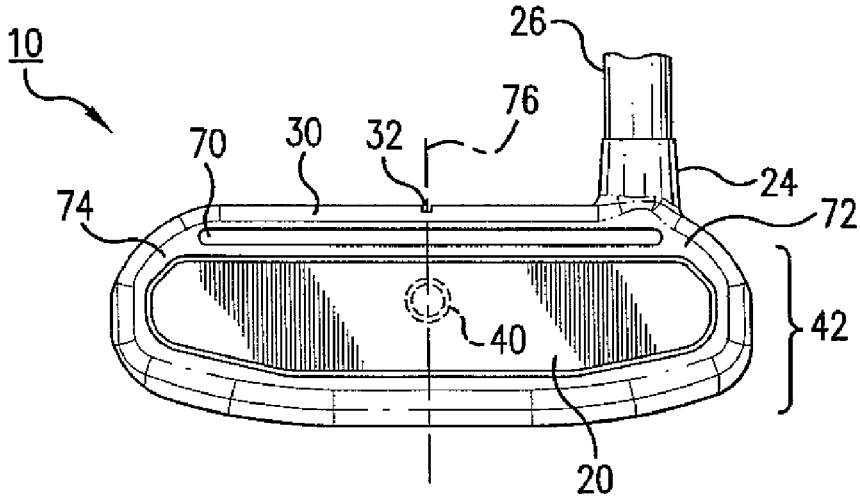
FIG. 2 is a front side view of an assembly as in FIG. 1.
Figure 3:
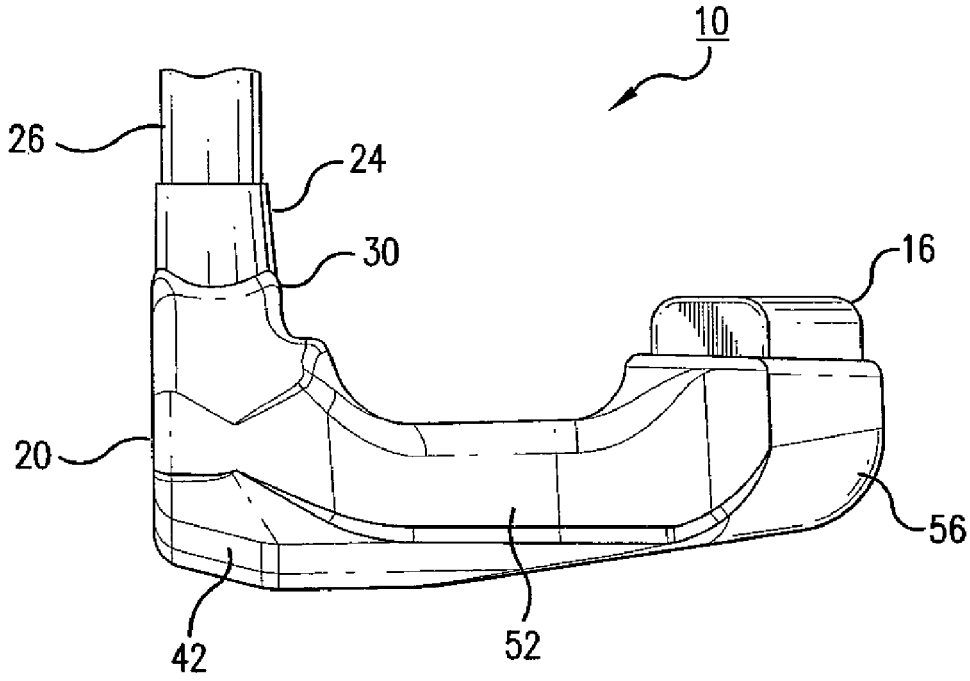
FIG. 3 is a lateral side view of an assembly as in FIGS. 1 and 2.
Figure 4:
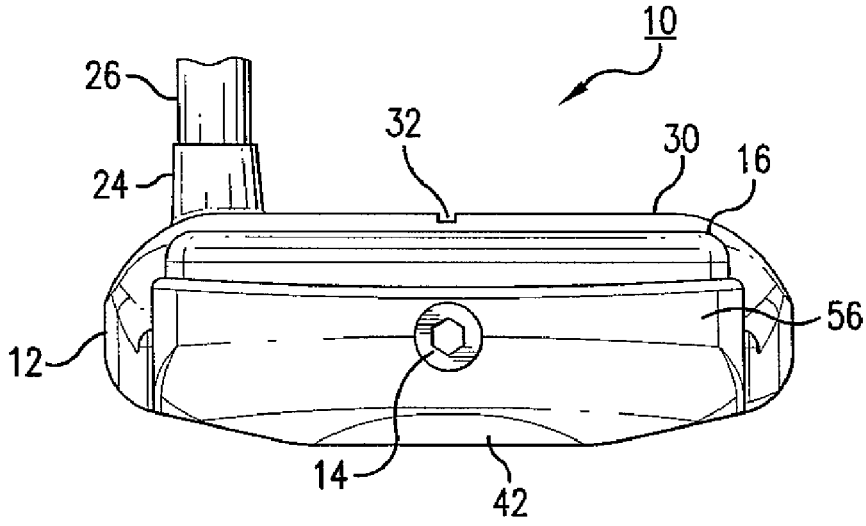
FIG. 4 is a rear side view of an assembly as in FIGS. 1-3.

As shown in FIGS. 1-3, frame 12 includes forward surface 20, which is the surface of assembly 10 that, in use, hits or strikes golf balls. Frame 12 is therefore an example of a striking component. In particular, assembly 10 is designed so that forward surface 20 imparts momentum to a golf ball most efficiently if assembly 10 is moving in an optimal direction, as illustrated by arrow 22; the term "optimal direction" is used herein to refer to a direction that is optimal for some purpose—in this case the direction is optimal because momentum is imparted most efficiently. In the illustrated example, forward surface 20 is approximately planar and arrow 22 is approximately perpendicular to the plane. Frame 12 also includes hosel 24 that has an appropriate structure to be connected to shaft 26 so that a user can swing assembly 10 on the end of shaft 26. For example, shaft 6 can fit into hosel 24 and can be fastened with any suitable epoxy resin or the like.

In the context of a golf club, forward surface 20 or another club head surface that strikes balls can provide an orientation framework as follows: "Forward" and "front" refer to a direction from the surface toward the ball being struck, while "behind", "rearward", and "rear" refer to an opposite direction. "Upward" and "downward" refer respectively to directions toward and away from the position at which a club is held while being swung by a golfer. "Lateral" refers to a direction that is approximately perpendicular both to a forward or rearward direction and also to an upward or downward direction; therefore, a component that has a forward surface may also extend "in a lateral direction" between "lateral ends". When a golf club is held by a golfer, the lateral end closer to the golfer may be called a "heel end" and the other end may be called a "toe end".

FIGS. 1-4 also show bridge 30, extending between the opposite ends of frame 14 above forward surface 20, and connected at each end to the part of frame 12 behind forward surface 20. Among its other features, bridge 30 includes central groove 32 extending across its upper surface in the optimal direction. Similarly, the upper surface of the part of frame 12 behind forward surface 20 includes side grooves 34 and 36 that are placed symmetrically in relation to central groove 32 and also central groove extension 38 that is aligned with central groove 32 in bridge 30 and is also directly above the front end of stylus 14. Because of this alignment, and because groove 32, groove extension 38, and the front end of stylus 14 are at different vertical levels, a golfer looking downward at club head assembly 10 can use them as focal or alignment points to ensure consistent geometric set-up on every stroke: As long as the club head is at the same position relative to the golfer's eyes on every stroke, all three focal points should line up and appear to be in one line—if they do not form a line every time a golf ball is hit, it could mean that the golfer is changing the set-up angle from one stroke to another, which could cause inconsistent results.

Stylus 14 is an arrow-like component as defined above because it is longer than it is wide and, due to this and other characteristics, it appears to point in a direction along its length, illustratively the optimal direction indicated by arrow 22. As can be seen in FIG. 1, stylus 14 becomes wider as it extends rearward from its connection to the part of frame 12 behind forward surface 20, and the change of width is one of the characteristics that gives stylus 14 the appearance of pointing; the tapering of stylus 14 toward a golf ball in front of the center of forward surface 20 creates an eye-pleasing, easy way to align the golf club head and the ball so that the ball follows a desired path. FIG. 2 also shows an outline of opening 40 in body 42, the part of frame 12 behind forward surface 20. As shown, body 42 extends in a lateral direction between its two lateral ends, and stylus 14 extends into opening 40 in body 42; stylus 14 can therefore be connected to frame 12 and held in position, such as by an epoxy resin or the like or by frictional contact, such as between threaded surfaces. At its rearward end, stylus 14 can be similarly connected to frame 12, as suggested by the rear view in FIG. 4.

In the implementation illustrated in FIG. 1, stylus 14 extends across a cutout or opening 50 within frame 12, so that a user looking downward at assembly 10 can see stylus 14 above a background of grass or other ground cover, making it easier for the user to see the optimal direction when preparing to swing assembly 10. This effect can be enhanced by the shape of opening 50 and arms 52 and 54: Opening 50 illustratively decreases in width as it extends rearward and arms 52 and 54 similarly have lateral edges that form a reverse angle, helping a user see the direction stylus 14 is pointing. Frame 12 includes arms 52 and 54, lateral connecting parts that are connected to the ends of body 42 and extend rearward on either side of opening 50. The rearward ends of arms 52 and 54 are connected to support 56, a rear connecting part that also functions to support weight 16. Therefore, support 56 and weight 16 together function as a weight part or weight component that is connected to and supported on arms 52 and 54. Arms 52 and 54 in turn function as connecting parts that support the weight part or component at a distance from forward surface 20. As discussed below, the distance of weight 16 from forward surface 20 affects the moment of inertia of the golf club.

FIG. 2 also illustrates separating gap 70 between bridge 30 and body 42. Although all the parts of frame 12 can be integrally formed, including bridge 30, body 42, arms 52 and 54, and support 56, gap 70 provides separation between bridge 30 and the other parts of frame 12. In principle, gap 70 could have any dimensions sufficient to provide such separation; in one implementation, a gap of 0.0625 inch was sufficient to help prevent twisting.

As a result of gap 70, when assembly 10 is swung on the end of shaft 26 connected to hosel 24, the swinging force provided through shaft 26 is applied to the two lateral ends of body 42 through bridge 30 and connectors 72 and 74. In other words, because of gap 70 and because hosel 24 is effectively between connectors 72 and 74 in the lateral direction, bridge 30 and connectors 72 and 74 act similarly to a yoke, allowing bridge 30 to pull the weight of assembly 10 in two approximately equal, spaced apart portions, one at each lateral end of bridge 30. It is believed that this yoke-like structure helps prevent twisting of assembly 10 about an approximately vertical axis when forward surface 20 hits or strikes a golf ball off-center, i.e. laterally from the center of forward surface 20. Because assembly 10 does not twist, the ball rolls in the direction of swing of assembly 10. It is further believed that this result is reinforced by the rearward positioning of a weight part that includes support 56 and weight 16, which are relatively heavy compared to arms 52 and 54; opening 50 between arms 52 and 54 further lightens the assembly's weight between forward surface 20 and the weight part.

This conclusion is supported by the following conceptual framework: In the implementation of FIGS. 1-4, bridge 30 and body 42 are examples, respectively, of upper and lower "lobe-like portions" of a golf club head assembly, meaning that they are divisions of the assembly that are each relatively large in size compared to a significant part of the assembly that is between them. In the example of FIGS. 1-4, bridge 30 and body 42 are connected at their lateral ends by connectors 72 and 74, examples of "end connections", meaning connections between upper and lower lobe-like portions that are at or near their lateral ends. Between connectors 72 and 74 is gap 70, an example of a "less connected region", a term used herein to refer to a region in which upper and lower lobe-like portions are not connected to each other as much as by their end connections; gap 70 is therefore an extreme example of a less connected region because bridge 30 and body 42 have no connection across gap 70, but a less connected region could, for example, also include at least some connection between upper and lower lobe-like portions, as described below regarding other implementations.

A further characteristic of the implementation of FIGS. 1-4 is that forward surface 20 has a lower part, the part in front of body 42, which is the part that, in normal use, strikes golf balls. In other words, the impact of a golf ball is received by assembly 10 through its lower lobe-like portion, while the swinging force from shaft 26 is received through its upper lobe-like portion. From this conceptual framework, it follows that an increased proportion of the swinging force is transferred to the golf ball from the upper lobe-like portion through the end connections to the lower lobe-like portion and thence to the lower part of the forward surface than would be transferred if the upper and lower lobe-like portions were uniformly connected at all points along a line extending in the lateral direction. In the example in FIGS. 1-4, all of the force is transferred through the end connections in this manner, producing the yoke-like effect described above.

The effect of this transfer of force on twisting can further be understood by considering distribution of mass: Assembly 10 has a lateral center of mass 76, a vertical surface illustrated as a dashed line in FIG. 2; the dashed line shows where lateral center of mass 76 intersects the vertical projection of forward surface 20—as can be seen, the less connected region exemplified by gap 70 intersects the lateral center of mass. The dashed line also illustrates an axis about which assembly 10 could twist when forward surface 20 hits a golf ball at a point that is not on lateral center 76; the twist about this axis is sometimes referred to herein as being twist "about the lateral center of mass". The magnitude of the twist about the lateral center of mass also depends, however, on moment of inertia (MOI), with the twist resulting from a given force being greater as MOI decreases. In general, MOI increases (and twist decreases) as the distance of weight 16 from forward surface 20 increases and also as the mass of weight 16 increases as a proportion of total club head weight.

It follows that increased transfer of swinging force through end connections and increased MOI both tend to decrease twist. Another factor that can also affect twist is "effective mass" of the lobe-like portions, meaning, for each portion, the mass that it would appear to have when its part of the forward surface hits a golf ball, treating the upper and lower lobe-like portions as if they were separated: In the example of FIGS. 1-4, bridge 30, the upper lobe-like portion, has nothing behind it, so that its effective mass only includes its own mass; on the other hand, arms 52 and 54 are connected behind the lower part of forward surface 20, to the lateral ends of body 42, the lower lobe-like portion, so that weight 16 contributes predominantly to the effective mass of body 42. As a result, the effective mass of body 42 is greater than the mass of bridge 30 and the center of mass of the club head is very low. It is believed that this also tends to decrease twist, perhaps because the momentum of the club head is therefore applied to the point of impact predominantly from the lower lobe-like portion.

Any combination of one or more of these factors can be applied to obtain a golf club head that has "negligible twist" about its lateral center of mass, meaning that the amount of twist that occurs when the forward surface hits a golf ball off-center is so small that the total twist is not more than 110 percent of the magnitude of twist that occurs from other causes, such as from the amount of twist imparted to the club head by an average golfer's swing, aerodynamic effects, and so forth.

As used herein, a combination of factors is "sufficiently" great, large, or the like that the club head has negligible twist about the lateral center of mass (or another such axis) if the described combination, together with typical values for other factors, results in negligible twist. For example, the effective mass of the lower lobe-like portion can be sufficiently greater than the upper lobe-like portion's mass and the first and second end connections can be sufficiently large relative to any connection in the less connected region between them that there is negligible twist, assuming a typical MOI value and other typical values. Or these factors can be sufficiently greater and large and also the distance and mass (and hence MOI) of a weight behind the forward surface can be sufficiently great that there is negligible twist, assuming other typical values.

In the implementation shown in FIGS. 1-4, hosel 24 is connected near one end of bridge 30, the heel end if assembly 10 is being swung by a right-handed golfer. Hosel 24 can, however, be connected at any appropriate position between the heel end and the toe end of bridge 30, whether for a right- or left-handed golfer. In general, the position at which hosel 24 is connected is related to the shape of shaft 26, and a bent shaft is typically appropriate for a hosel position as in FIGS. 1-4, while a straight shaft would be appropriate if hosel 24 were centered. Furthermore, the yoke-like effect mentioned above may require that the horizontal center of area of hosel 24 be inward from the horizontal center of area of each end connection, which is true of the implementation in FIG. 2 and would also be true if hosel 24 were centered. Applicable regulations may also limit dimensions that can be used; for example, the distance from the bend in a bent shaft to the sole of the golf club may be limited, such as to 5.00 inches for a putter.

Figure 5:
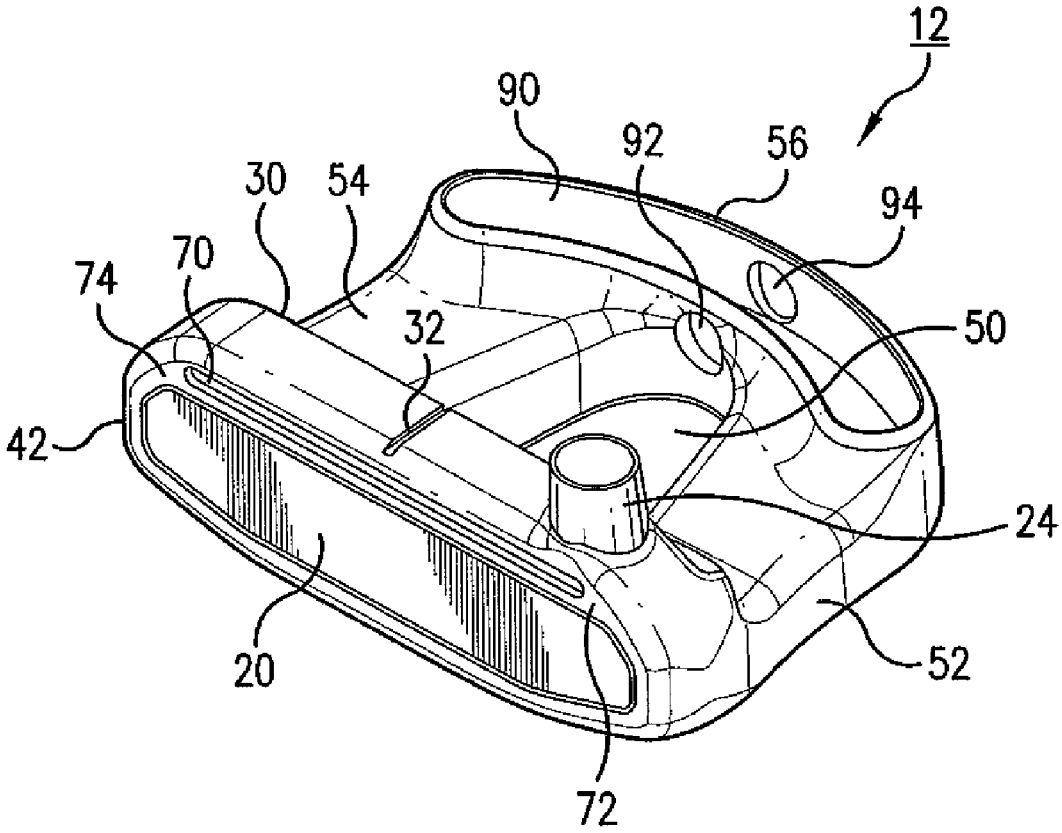
FIG. 5 is a perspective view of a frame that can be used in an assembly as in FIGS. 1-4.

FIG. 5 shows an implementation of frame 12 that could be used in the assembly illustrated in FIGS. 1-4. The parts of frame 12 in FIG. 5 are labeled with the same reference numerals as in FIGS. 1-4. In addition to features described above, FIG. 5 shows that support 56 includes curved groove 90 into which weight 16 can be inserted. In addition, the forward and rearward walls bounding groove 90 have respective circular openings 92 and 94 defined in them, through which stylus 14 can be inserted.

In exemplary implementations, frame 12 would be produced from aluminum by a combination of casting and machining, but any appropriate manufacturing technique could be used, and any other suitable material or combination of materials could similarly be used. For example, stainless steel could be used rather than aluminum, and it is foreseeable that various other materials could be used to produce a frame. Furthermore, although frame 12 would illustratively be formed as a single piece, various other techniques could be used to produce a similar structure from more than one piece. Frame 12 could have various sizes and shapes, and experimentation indicates that gap 70 can be 0.0625 inches or less in width, which is compatible with USGA requirements. In one implementation, gap 70 separates upper and lower lobe-like portions by approximately 0.0125 inches or less.

Figure 6:
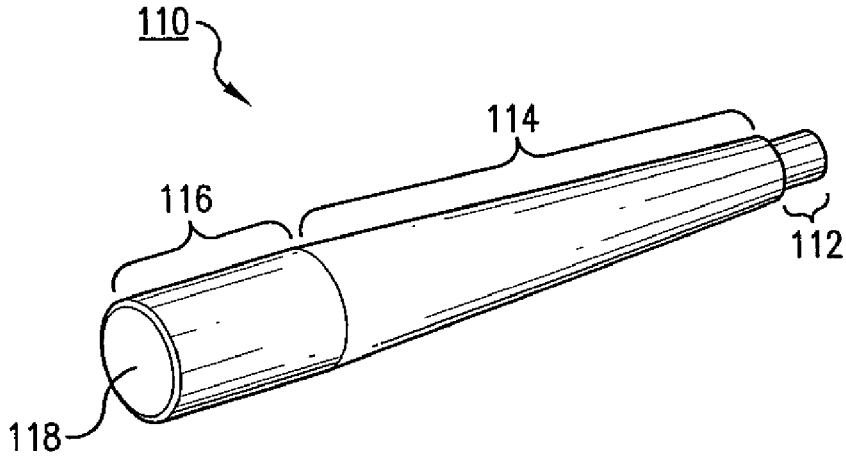
FIG. 6 is a perspective view of a stylus that can be used in an assembly as in FIGS. 1-4.

FIG. 6 shows stylus 110, an example of a stylus that could be used in assembly 10 in FIGS. 1-4. Stylus 110 has three distinct parts, all of which are symmetrical about the same axis. Small part 112 is the part that can be inserted into opening 40 in body 42 and can be attached by an epoxy resin or any other appropriate fastening technique. Tapered part 114 has a diameter that increases from slightly larger than the diameter of small part 112 to the diameter of large part 116. The diameter of large part 116 is slightly less than the inner diameters of openings 92 and 94, and the overall length of stylus 110 is such that the exposed end 118 is approximately flush with the outer surface of support 56 when stylus 110 is connected to frame 12. In addition to the attachment of small part 112 inside opening 40, large part 116 can be attached to support 56 by an epoxy resin or any other appropriate fastening technique.

Figure 7:
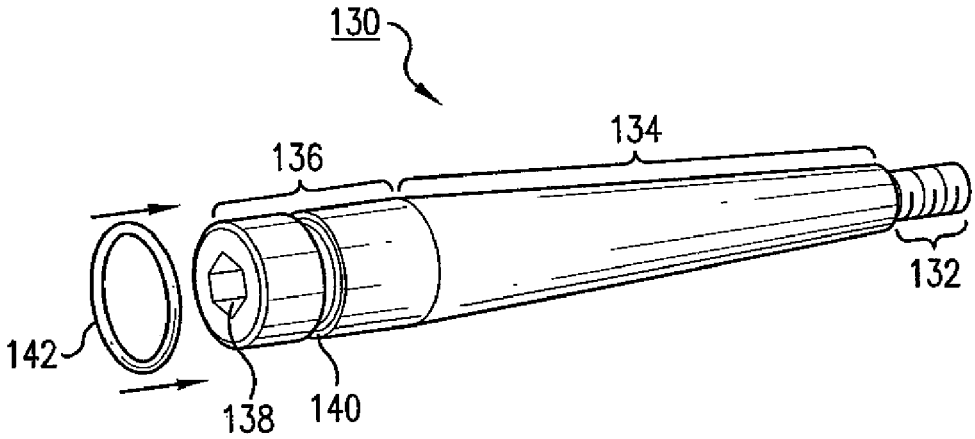
FIG. 7 is a perspective view of another stylus that can be used in an assembly as in FIGS. 1-4.
Figure 8:
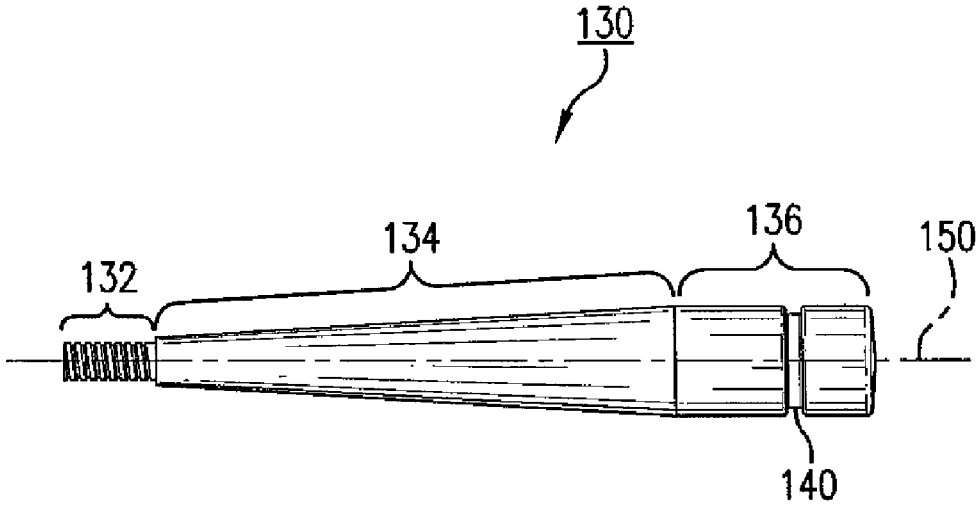
FIG. 8 is a top plan view of the stylus of FIG. 7.

FIGS. 7 and 8 illustrate an alternative, stylus 130, in which the outer surface of small part 132 is threaded, tapered part 134 is similar to tapered part 114 in FIG. 6, and the large part 136 has a hexagonal opening defined in the end so that a hexagonal wrench can be inserted in it to turn stylus 130, causing the threads of small part 132 to engage inward-facing threads in opening 40 in body 42. The straight shape of stylus 130 facilitates its removal and replacement in this manner. Also, large part 136 has annular groove 140 formed at an appropriate point along its length and O-ring 142 can be rolled onto the end of large part 136 until it seats in annular groove 140, where it can help provide a tight mechanical connection between stylus 130, frame 12, and a weight, as described below, while allowing at most "negligible momentum" to be transferred through stylus 130 to body 42; the term "negligible momentum" in this context refers to an amount of momentum that does not exceed approximately 110 percent of the momentum solely attributable to the mass of stylus 130. O-ring 142 could, for example, be made of Viton®, an excellent rubber-like material for damping or preventing vibration that also resists the effects of chemicals and weather and maintains its elasticity.

As suggested, for example, in FIG. 8, either of styluses 110 or 130 could be produced using a lathe or other conventional techniques. In exemplary implementations, styluses would be produced from stainless steel, but any other suitable material could be used. The dimensions of a stylus can be coordinated with the dimensions of frame 12 to obtain a stable connection between the stylus and the frame. As shown most clearly in FIG. 8, stylus 130 is symmetrical about an axis 150 with tapered part 134 varying smoothly from the diameter of large part 136 down to a diameter slightly larger than that of small part 132. Various other shapes could, however, be used.

Figure 9:
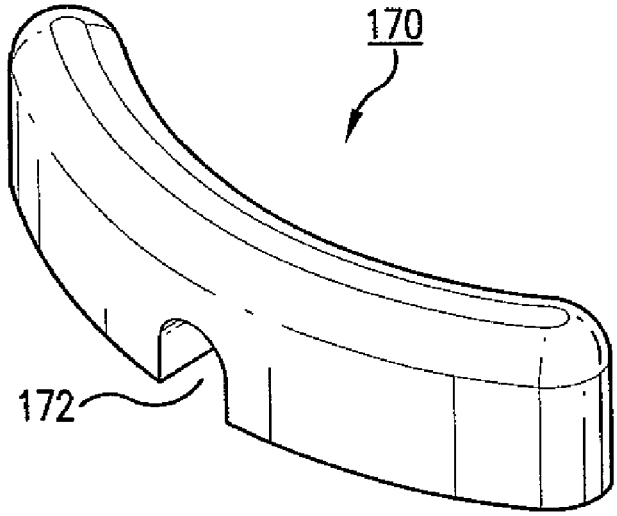
FIG. 9 is a perspective view of a weight that can be used in an assembly as in FIGS. 1-4.
Figure 10:
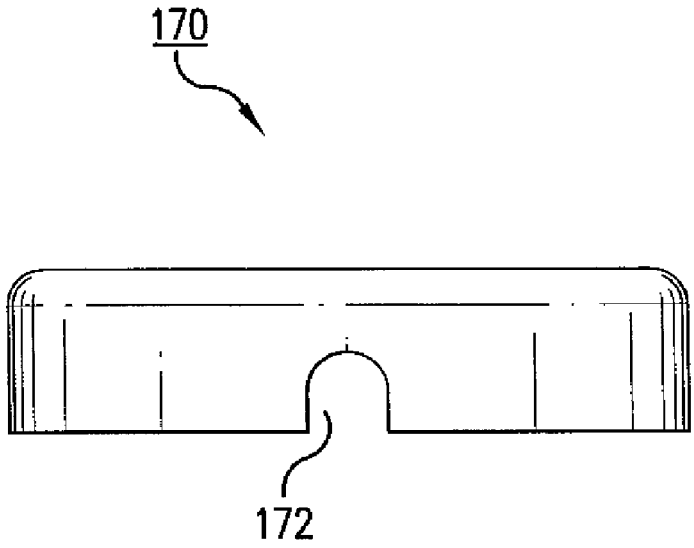
FIG. 10 is a side view of a weight as in FIG. 9.

FIGS. 9 and 10 show two views of weight 170, an example of a weight that can be used with frame 12 and stylus 110. As shown in the perspective view of FIG. 9, weight 170 has an outer surface that is curved and sized to fit snugly into groove 90 for connection to frame 12, such as by an epoxy resin or the like. In addition, as also shown in the side view of FIG. 10, weight 170 has an opening 172 defined therein and positioned so that stylus 110 can extend through openings 92 and 94 in support 56 and also through opening 172.

Weight 170 is an example of an "arc-shaped" weight or weight structure, and groove 90 is similarly an example of an "arc-shaped" recess, illustratively also an upward-facing recess though such a recess could also be implemented to face downward; the term "arc-shaped" is used herein to refer to a shape that approximates a part of a circle not exceeding a semicircle.

Use of an arc-shaped recess and arc-shaped weights that fit therein can allow easy mounting of a weight, and, as described in more detail below, can also allow easy replacement if appropriately implemented. Also, an arc-shaped weight or weight structure can be mounted such that its center of curvature is toward the front surface of a golf club head, in which case its central section is at a greater distance from the front surface than its sides, which tends to increase MOI, helping to prevent twist about a lateral center of mass.

In an exemplary implementation, weight 170 would be manufactured by a combination of casting and machining with a bronze alloy that also includes magnesium and with a suitable total weight. Any other appropriate material could be used, however, including alloys that also incorporate tungsten, and weights could be manufactured by any appropriate combination of casting and machining.

Figure 11:
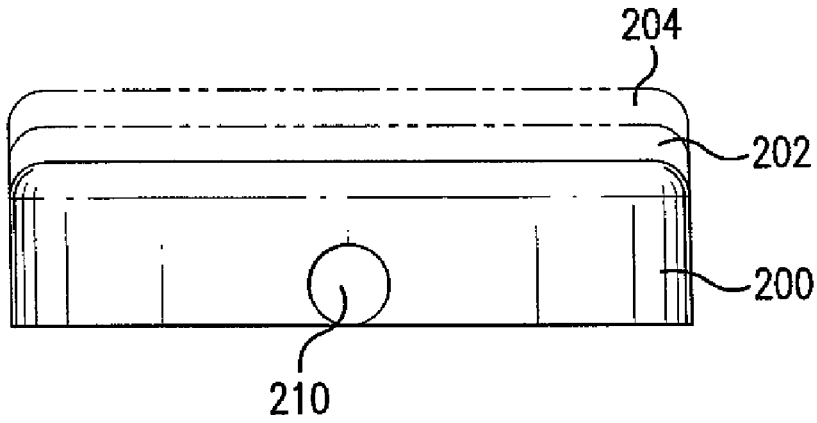
FIG. 11 is a side view showing profiles of a set of removable weights that can be used in an assembly as in FIGS. 1-4.

FIG. 11 shows a set of three removable weights 200, 202, and 204, superimposed so that opening 210 extends through all three weights. For example, weight 200 can be 105 grams, weight 202 can be 130 grams, and weight 204 can be 155 grams. Due to the cylindrical inner wall around opening 210, weights 200, 202, and 204 are appropriate for use with frame 12 and stylus 130 as in FIGS. 7 and 8. As stylus 130 is turned into opening 40 in frame 12, O-ring 142 in groove 140 engages the outer wall of opening 210, providing a frictional and mechanical resistance that prevents stylus 130 from changing position after insertion; this resistance is enhanced if opening 210 is off center from openings 92 and 94, such as 0.010 inch in an upward direction, causing stylus 130 and O-ring 142 to exert a downward force against the weight so that it is held tightly against the bottom of groove 90. Later, however, if the user wishes to change from one weight to another, the user can remove stylus 130, remove the weight currently in groove 90 in support 56, insert the new weight into groove 90, and then again insert and tighten stylus 130 to hold the weight in place.

In an exemplary implementation, a set of removable weights similar to those in FIG. 11 would be produced from 660 bronze alloy. As with weight 170, a suitable combination of casting and machining would be used to produce each weight, although the weights could be produced by any other combination of casting and machining, and with any other suitable material.

Figure 12:
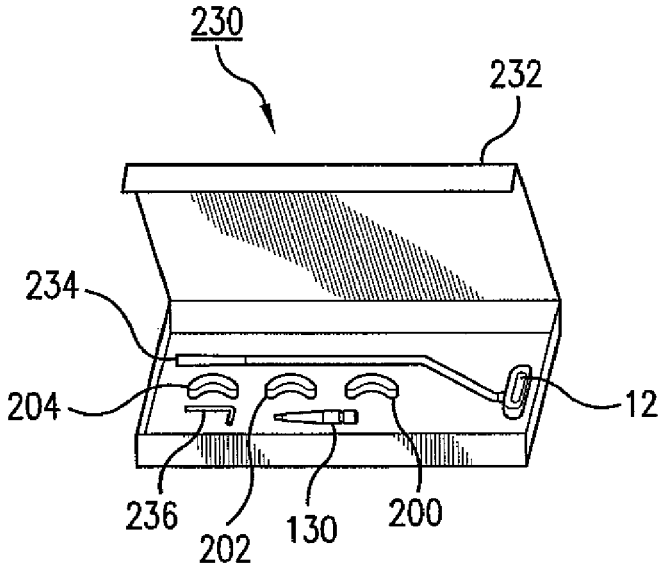
FIG. 12 is a perspective view of a golf club product that includes a set of removable weights as in FIG. 11.

FIG. 12 shows product 230, a golf club product that includes container 232 as well as stylus 130 with a mounted O-ring; a set of removable weights 200, 202, and 204; frame 12 attached to shaft 234; and hexagonal wrench 236, which could optionally have an ornamental handle (not shown). Stylus 130 and one of removable weights 200, 202, and 204 could optionally be preinstalled in frame 12 rather than being disassembled as shown. Although container 232 is illustratively a box, any other suitable container could be used and various other combinations of parts could be included in such a product. A product as in FIG. 12 provides a convenient combination of components, allowing a golfer to assemble a golf club and then, by replacing one removable weight with another, adjust it to suit the golfer's preferences.

Figure 13:
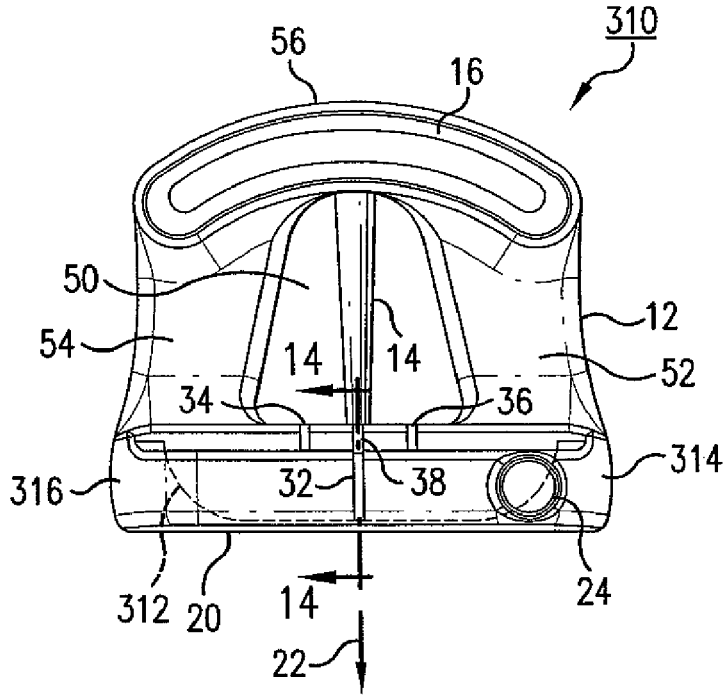
FIG. 13 is a top plan view of another golf club head assembly with a stylus.
Figure 14:
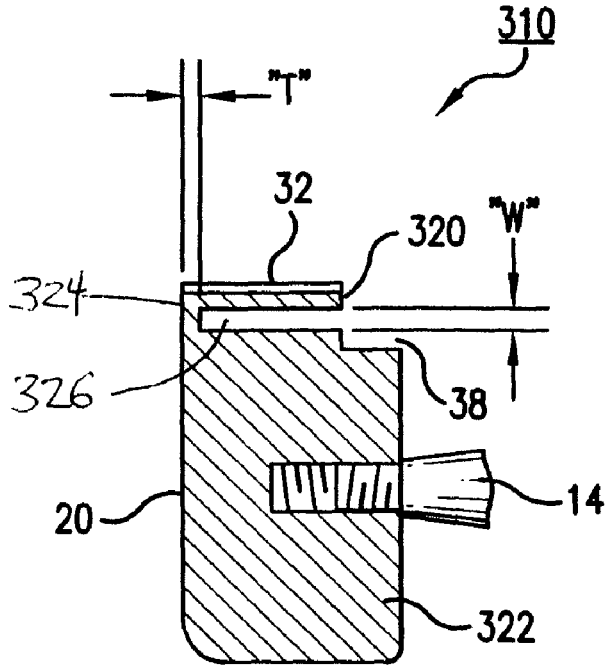
FIG. 14 is a cross section of a golf club head assembly, taken along the line 14-14 in FIG. 13.
Figure 15:
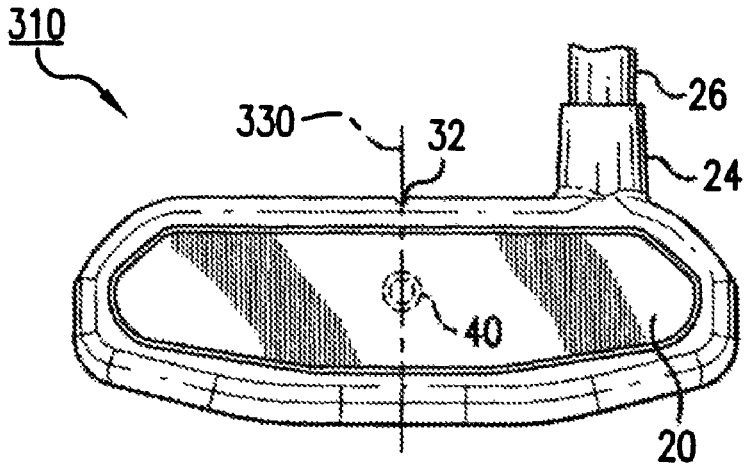
FIG. 15 is a front side view of an assembly as in FIGS. 13 and 14.

FIGS. 13-20 illustrate other features that could be used in product 230 in FIG. 12. FIGS. 13-15 illustrate features of an alternative club head assembly. Although the features in FIGS. 13-15 could be implemented with stylus 14 and weight 16 as described above in relation to FIGS. 1-11, FIG. 16 illustrates features of an alternative stylus, and FIGS. 17-20 illustrate features of an alternative weight structure.

Golf club head assembly 310 in FIGS. 13-15 is similar to assembly 10, described above in relation to FIGS. 1-4, and similar parts are labeled with the same reference numerals. Unlike assembly 10, however, assembly 310 does not include gap 70 (FIG. 2) between bridge 30 and body 42. Instead, as shown by dashed line 312 in FIG. 13, the upper and lower lobe-like portions of assembly 310 are connected in the less connected region between their lateral end connections 314 and 316. In FIG. 13, end connections 314 and 316 are between dashed line 312 and the outer perimeter of assembly 310, and hosel 24 is between the centers of end connections 314 and 316.

As can be seen in the cross section in FIG. 14, upper lobe-like portion 320 and lower lobe-like portion 322 are connected in the less connected region by connecting portion 324. Connecting portion 324 can remain, for example, after machining a solid piece of aluminum to produce slot 326 between upper and lower lobe-like portions 320 and 322 and behind connecting portion 324. Slot 326 could be produced, for example, by a Woodruff-style cutter. In practical implementations, it has been possible to produce assembly 310 with connecting portion 324 having a thickness as small as 0.03 inch without breaking through forward surface 20, as shown in FIG. 14. It might be possible to produce a thickness as small as 0.01 inch by machining, in which case connecting portion 324 might operate almost like a membrane, but larger thicknesses may be necessary if casting a single piece of aluminum that includes upper and lower lobe-like portions 320 and 322 and connecting portion 324. In one implementation, for example, the connecting portion has a thickness not exceeding approximately 0.1 inch between the upper and lower lobe-like portions. Successful implementations have been produced by machining billets of aircraft grade aluminum such as 6061-T6 aluminum.

An important feature of connecting portion 324 is that it is sufficiently thin that twisting about lateral center of mass 330 is prevented. As explained above in relation to gap 70 (FIG. 2), twisting can be negligible if the effective mass of the lower lobe-like portion is sufficiently greater than the upper lobe-like portion's mass and the lobe-like portions are not connected except at their ends. In the implementation in FIGS. 13-15, however, it is also necessary that end connections 314 and 316 in the regions laterally outside connecting portion 324 are sufficiently large relative to connecting portion 324 that twist about lateral center of mass 330 is negligible when forward surface 20 strikes a golf ball at a position laterally displaced from center of mass 330. It is believed that this result may be obtained if connecting portion 324 has a thickness T not exceeding approximately 0.050 inch, while each of end connections 314 and 316 has a cross-sectional area of approximately 0.125 inch or greater. More specifically, it is believed that successful implementations can be obtained with T having a value between approximately 0.015 and 0.030 inch.

As shown in FIG. 14, slot 326 has a width W between upper and lower lobe-like portions 320 and 322. Slot 326 has been successfully implemented with W of approximately 0.0625 inch, but various other values for W could be implemented without reducing the twist-preventing feature described above.

Figure 16:
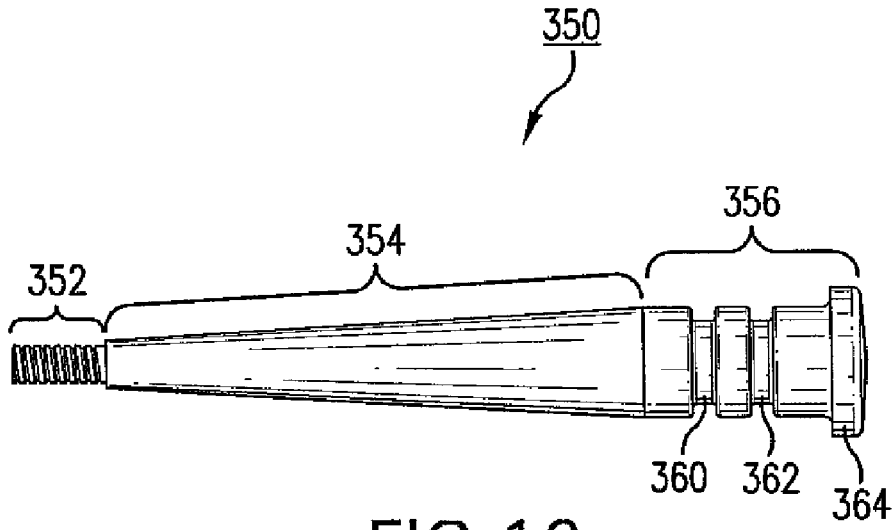
FIG. 16 is top plan view of another stylus that can be used in an assembly as in FIGS. 1-4 or FIGS. 13-15.

Stylus 350 in FIG. 16 resembles stylus 130 in FIGS. 7-8, with the outer surface of small part 352 threaded, tapered part 354 similar to tapered part 134, and large part 356 having a hexagonal opening (not shown) defined in the end so that a hexagonal wrench can be inserted in it to turn stylus 350, causing the threads of small part 352 to engage inward-facing threads in opening 40 (FIG. 15). Also, large part 356 has annular grooves 360 and 362 formed at appropriate points along its length and O-rings (not shown) can be rolled onto stylus 350 from small part 352 until they seat in annular grooves 360 and 362, where they help provide a tight mechanical connection between stylus 350, frame 12, and a weight structure, as described below, while transferring only negligible momentum from the weight structure to stylus 350 when forward surface 20 (FIG. 15) strikes a golf ball. Stylus 350 also has head 364 with a slightly larger diameter, which further helps to provide a tight mechanical connection, as described below.

FIGS. 17-20 show weight structure 380, an example of a weight structure that can be used with frame 12 and stylus 350. As shown in the perspective view of FIG. 17, weight structure 380 has an outer surface similar to weight 170 (FIG. 9), as described above. Weight structure 380 includes solid part 382 and flexible layered part 384, through both of which extends opening 386, positioned so that stylus 350 can extend through openings 92 and 94 in support 56 (FIG. 5) and also through opening 386.

Flexible layered part 384 operates to damp vibration when a golf club head's forward surface strikes a golf ball. As a result, a golfer can enjoy a non-vibrating, soft feel in using a golf club such as a putter with weight structure 380 on it; specifically, a putter with weight structure 380 may not need an anti-vibration insert on its forward face.

As can be understood from FIG. 5, showing curved groove 90, weight structure 380 can be mounted in a recess on a golf club head assembly. The shape of the recess and the shape of weight structure 380 can be the same, so that weight structure 380 fits snugly into the recess. Weight structure 380 could, however, be mounted on a golf club in various other ways.

The outer surface of solid part 382 includes a "mounting surface", used herein to refer to surface that is disposed toward a golf club when a weight structure is mounted on the golf club. In the illustrated example, a mounting surface is approximately in a "mounting plane", and faces downward above lower surface 390 of flexible layered part 384. In addition, flexible layered part 384 has inner and outer sides that are opposite each other, with only the outer side being shown in FIG. 17. The inner side illustratively is on and covers all of the mounting surface, although it might be possible to implement flexible layered part 384 in a way that would not cover all of the mounting surface but at least substantially all of it and would therefore damp vibration. The outer side of flexible layered part 384 is disposed toward the golf club, and part of it can be on the floor-like upward-facing surface of curved groove 90 (FIG. 5).

In the illustrated implementation, in addition to covering the mounting surface, flexible layered part 384 also covers a large part if not all of side surfaces of solid part 382. The side surfaces extend from where they meet the mounting surface in a direction approximately perpendicular to the mounting plane, which direction extends upward in the illustrated example. Therefore, if, as illustrated in FIG. 5, weighted structure 380 is mounted in a recess that has vertical walls around it, flexible layered part 384 also separates solid part 382 from the surfaces of the walls of the recess.

In another implementation, each of the side surfaces extends in the direction approximately perpendicular to the mounting plane to an upper end. The upper ends of the side surfaces together lie approximately in an end plane. Solid part 382 has, for each side surface, a respective stop surface that extends outward from side surface's upper end approximately in the end plane. Flexible layered part 384 is on substantially all of the side surfaces between the mounting surface and the stop surfaces.

In one successful implementation, flexible layered part 384 has been implemented as a "rubber boot" that can be slipped onto and off of solid part 382. Therefore, flexible layered part 384 can be manufactured by molding an appropriate material, such as ethylene propylene diene monomer (EPDM) or Buna N rubber or another appropriate elastomeric material to obtain the desired shape, and then slipping it onto solid part 382, which can be manufactured in substantially the same manner as described above in relation to FIGS. 9-11. Alternatively, flexible layered part 384 could be molded directly on solid part 382 with any appropriate process. EPDM is extremely durable and resists weather and corrosive agents, and, though it does not always damp vibration as well as Viton® would, it is more economical to use. Flexible layered part 384 has been implemented successfully with EPDM material as thin as 0.025-0.030 inch, which may approach the minimum thickness at which it can be molded.

Figure 17:
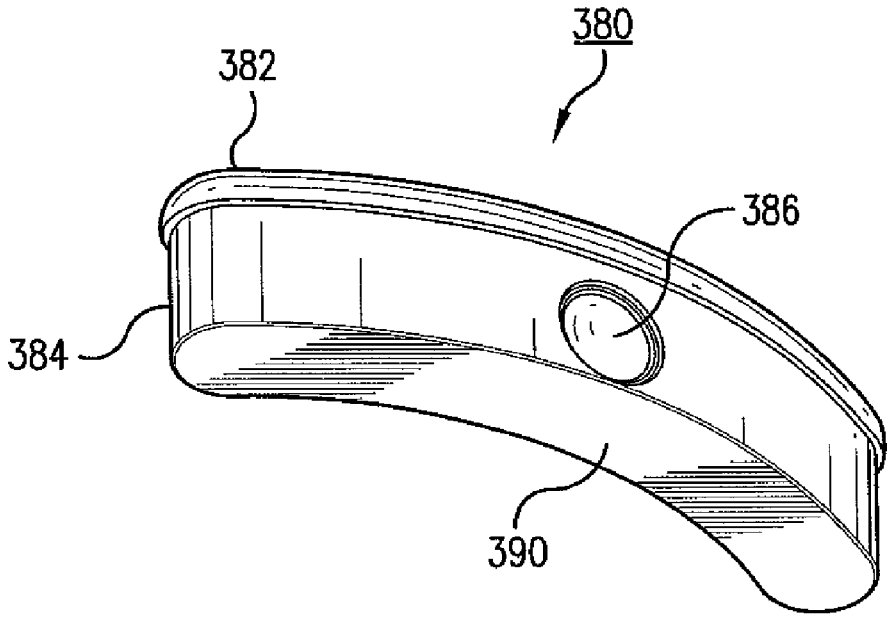
FIG. 17 is a perspective view of a weight structure that can be used in an assembly as in FIGS. 1-4 or FIGS. 13-15.

In the implementation illustrated in FIG. 17, flexible layered part 384 is sufficiently thick to prevent any direct contact between solid part 382 and the golf club, because it maintains a continuous flexible layer at all points at which such contact could occur when weight structure 380 is mounted on a golf club. Nevertheless, it may be advantageous for curved groove 90 (FIG. 5) or another appropriately shaped recess in which weight structure 380 is mounted to be slightly larger than the outer dimensions of weight structure 380; for example, a larger recess could reduce the total mass of a golf club.

Figure 18:
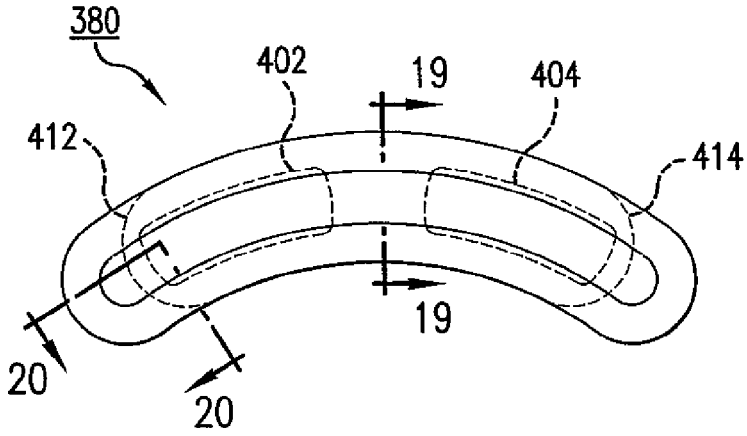
FIG. 18 is a schematic top view of a weight structure as in FIG. 17.
Figure 19:
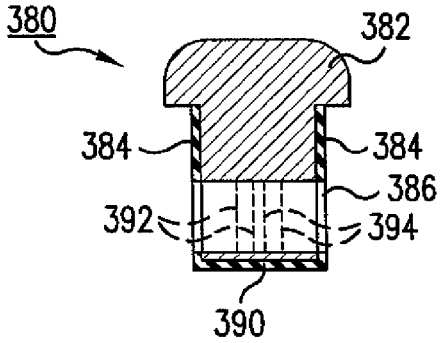
FIG. 19 is a cross section of a weight structure, taken along the line 19-19 in FIG. 18.
Figure 20:
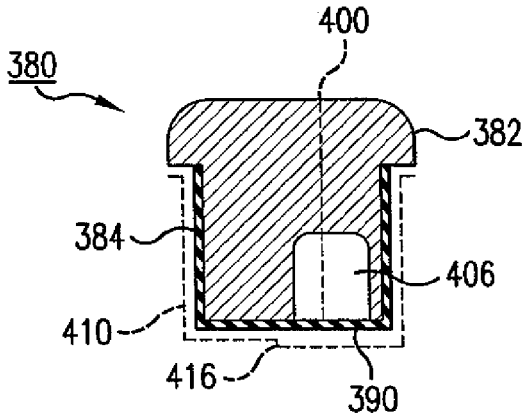
FIG. 20 is a cross section of a weight structure, taken along the line 20-20 in FIG. 18.

FIG. 18 is a schematic top view of weight structure 380, showing lines along which the cross sections of FIGS. 19 and 20 are taken. FIG. 19 illustrates a cross section through opening 386, while FIG. 20 illustrates a cross section from one end of weighted structure 380, illustrating how recesses can affect its total mass.

FIG. 19 shows how opening 386 extends through the center of weight structure 380, through flexible layered part 384 on each side and, in between, through solid part 382. The opening through solid part 382 can be formed by drilling, for example, while the opening through flexible layered part 384 can be a feature of the mold in which it is fabricated. Dashed lines 392 and 394 illustrate where the O-rings in annular grooves 360 and 362 contact the inner wall of solid part 382 within opening 386. The position at which small part 352 of stylus 350 is held in opening 40 operates as a fulcrum, and opening 386 is positioned so that stylus 386 exerts downward pressure on the lower side of opening 386 through the O-rings, firmly holding weight structure 380 in position in curved groove 90 (FIG. 5). The O-rings in annular grooves 360 and 362 receive the pressure from stylus 350 and, in turn, apply it to solid part 382, in effect pushing solid part 382 downward against flexible layered part 384. As will be understood, opening 386 need be only slightly eccentric from the center of stylus 350 in order to achieve this result. In addition, a larger O-ring (not shown) adjacent the shoulder of head 364 of stylus 350 can be tightened against the outer side of weight structure 380, pushing weight structure 380 forward so that the forward side of flexible layered part 384 is held against the forward wall of curved groove 90 (FIG. 5). One consequence of the combination of downward and forward pressure and the presence of flexible layered part 384 is that all metal-to-metal contact between solid part 382 and other parts of the golf club head assembly is prevented, so that no ping-like sound occurs when a golf ball is hit, and, further, vibration is dampened by flexible layered part 384.

As described above, the O-rings can be Viton® O-rings to more effectively prevent vibration as well as providing chemical and weather resistance and long-lasting elasticity. In addition to their effects on preventing vibration, the O-rings are sufficiently elastic that they do not allow any significant momentum from weight structure 380 to be transferred to stylus 350, so that substantially all momentum from weight structure 380 is transferred through arms 52 and 54 (FIG. 13) to lower lobe-like portion 322 of golf club head assembly 310.

FIG. 20 shows a cross section that includes a lengthwise part at left and a lateral part at right, with the two parts meeting along dashed line 400. As suggested by dashed lines 402 and 404 in FIG. 18, solid part 382 includes two symmetrically positioned and shaped recesses, reducing its mass from what it would be without the recesses, and the cross section in FIG. 20 illustratively shows recess 406, the recess bounded by dashed line 402. The heights of recesses can be increased to further reduce mass. To increase mass, on the other hand, the outside height of solid part 382 can be increased by an appropriate amount. In an exemplary implementation, weight structures with weights of 88, 98, and 118 grams are produced with the same outside height of solid part 382 but with decreasing heights of recesses. Then, with no recesses, weights of 138 and 148 grams are produced with increasing outside heights.

FIG. 20 also shows dashed line 410, representing a facing surface of a recess in which weight structure 380 can be mounted. The floor-like upward-facing part of the surface represented by line 410 has a step at each end, represented by dashed lines 412 and 414 (FIG. 18). FIG. 20 shows how lower surface 390 rests on the higher surface to the left of step 416, the step represented by dashed line 412, but is slightly spaced above the lower surface to the right of step 416, providing added stability because weight structure 380 has only three points of contact or connection with the floor-like part of the surface, two at its ends and a third at its center due to downward pressure from stylus 350.

In one exemplary implementation of a set of weight structures, each structure's solid part 382 has an outside width, such as across the cross section of FIG. 19, of 0.525 inch, while the outside width of its flexible layer part 384 is approximately 0.475 inch and its thickness is approximately 0.03 inch. Flexible layer part 384 has an outside height of approximately 0.570 inch, which while the height of the side walls of solid part 382 is 0.540 inch. The diameter of opening 386 inside solid part 382 is 0.378 inch, and 0.388 inch through flexible layer part 384 to allow an offset tolerance, and the center of opening 386 in each case is 0.223 inch above the mounting surface. In a counterpart implementation of golf club head assembly 310, step 416 has a height of 0.006 inch.

A golf club head assembly with a stylus and weight or weight structure as described above could be produced with materials that are finished in various combinations. For example, a weight structure's solid part could be made of plated mild steel and could have a finish that contrasts with those of the golf club head assembly and the stylus, such as electroless satin nickel plating in contrast with an anodized black finish or a black chrome finish in contrast with a silver or marble-like Eternalum® finish.

The exemplary implementations described above are illustrative and could be prototyped, tested, and produced with specific shapes, dimensions, materials and other characteristics, but the scope of the invention includes various other shapes, dimensions, materials, and characteristics. For example, the particular shape of each of the parts could be different, and could be of appropriate sizes for any particular type of golf club. Furthermore, rather than being assembled from separate parts or components that have been fabricated as described, including conventional machining techniques for smooth edges and so forth, the assemblies as described above could be manufactured in various other ways and could include various other materials. For example, some parts and components could be integrally formed.

Similarly, the exemplary implementations described above include specific examples of striking components, arrow-like components, front parts, connecting parts, weight parts and components, weight structures, lobe-like portions, laterally extending parts, yoke-like parts, hosels, shafts, and so forth, but any appropriate implementations of those parts and components could be employed. Also, various putters or other golf clubs could be provided with a variety of shaft configurations and lengths, including e.g. both right- and left-handed models, so that a buyer can choose one that is suitable The exemplary implementations described above include arrow-like components that are stylus-like, but various other techniques could be used to provide an arrow-like component. Furthermore, the exemplary implementations employ curved weight parts and components that fit into a pocket-like groove in a frame, but differently shaped weight parts and components could be used with different ways of connecting to frames.

The exemplary implementations described above prevent twisting through several factors, and any combination of those factors could be employed to prevent twist, possibly together with additional factors. Similarly, the above-described exemplary implementations employ various flexible parts to damp or prevent vibration, such as from metal-to-metal contact, but other and additional flexible parts could be employed: For example, O-rings could be positioned around, below, or at the sides of weights mounted on a golf club head to damp or prevent vibration.

While the invention has been described in conjunction with specific exemplary implementations, it is evident to those skilled in the art that many alternatives, modifications, and variations will be apparent in light of the foregoing description. Accordingly, the invention is intended to embrace all other such alternatives, modifications, and variations that fall within the spirit and scope of the appended claims.

What is claimed is:

1. A club head article that can be connected to a shaft to produce a golf club, the article comprising:

a striking component with a forward surface that, in use, strikes golf balls; the forward surface imparting momentum to a golf ball most efficiently if it is moving in an optimal direction when it strikes the golf ball; and a conical stylus connected to the striking component behind its forward surface; the conical stylus decreasing linearly in width from a rear end toward a front end extending approximately in the optimal direction so that a user swinging the golf club can see the conical stylus pointing approximately in the optimal direction.

2. A method of producing a golf club that includes the club head article of claim 1, the method comprising:

producing the club head article of claim 1; and connecting the club head article to a shaft.

3. A club head article that can be connected to a shaft to produce a golf club, the article comprising:

a front part extending in a lateral direction and having first and second lateral ends and a forward surface between the first and second lateral ends, the forward surface, in use, striking golf balls;

first and second connecting parts that connect to and extend approximately rearward from the front part's first and second lateral ends, respectively; the first and second connecting parts being spaced apart;

an arrow-like component connected to the front part behind its forward surface; the arrow-like component extending approximately in the optimal direction so that a user swinging the golf club can see the arrow-like component pointing approximately in the optimal direction;

a laterally extending part that is connected between the first and second connecting parts at a distance from the forward surface; and an arc-shaped weight structure connected to the laterally extending part; the arc-shaped weight structure having a center of curvature forward of the laterally extending part.

4. The article of claim 3 in which the laterally extending part is integrally formed with the first and second connecting parts and has an upward-facing arc-shaped recess larger than the arc-shaped weight structure, the arc-shaped weight structure being removably mounted in the arc-shaped recess.

5. The article of claim 3 in which the front part and the first and second connecting parts are integrally formed.

6. A method of producing a golf club that includes the club head article of claim 3, the method comprising:

producing the club head article; and connecting the club head article to a shaft.

7. A club head article that can be connected to a shaft to produce a golf club, the article comprising:

a front part that extends in a lateral direction and having first and second lateral ends and a forward surface extending between the first and second lateral ends; the front part including:

an upper bridge portion and a lower body portion behind the forward surface, each extending in the lateral direction between the first and second lateral ends; the forward surface having a lower part on the lower body portion, the lower part, in use, ordinarily striking golf balls; and first and second end connections between the upper bridge and lower body portions at the first and second lateral ends, respectively and, between the first and second end connections, a less connected region that intersects a lateral center of mass of the club head article; and a hosel that is connected to the upper bridge portion between centers of the first and second end connections and that can be connected to a shaft; an effective mass of the lower body portion being sufficiently greater than the upper bridge portion's mass and the first and second end connections being sufficiently large relative to any connection in the less connected region that the club head has negligible twist about the lateral center of mass when, as a result of force received through the hosel, the forward surface's lower part strikes a golf ball at a position laterally displaced from the lateral center of mass.

8. The article of claim 7 in which the front part further includes:

a connecting portion that connects the upper bridge and lower body portions in the less connected region.

9. The article of claim 8 in which the connecting portion has a thickness not exceeding approximately 0.1 inch between the upper bridge and lower body portions.

10. The article of claim 9 in which the connecting portion has a thickness between approximately 0.03 and 0.05 inch.

11. The article of claim 7 in which the upper bridge and lower body portions are integrally formed.

12. The article of claim 7 in which the upper bridge and lower body portions are separated by a gap in at least part of the less connected region.

13. The article of claim 12 in which the gap separates the upper bridge and lower body portions by approximately 0.125 inch or less.

14. A method of producing a golf club that includes the club head article of claim 7, the method comprising:

producing the club head article; and connecting the club head article to a shaft.

15. A club head article that can be connected to a shaft to produce a golf club, the article comprising:

a body that includes a striking component that, in use, strikes golf balls, the body having a recess surface; and a weight structure mounted on the body, the weight structure comprising:

a solid part having a mounting surface that is disposed toward the recess surface; and a flexible layered part that has first and second opposite sides and that is on the solid part; the first side being on at least substantially all of the solid part's mounting surface; the second side being disposed toward the recess surface; the flexible layered part damping vibration when the striking component strikes a golf ball.

16. The article of claim 15 in which the flexible layered part is removable from the solid part and replaceable.

17. The article of claim 15 in which the mounting surface lies approximately in a mounting plane and the solid part has side surfaces that all extend from where they meet the mounting surface in a direction approximately perpendicular to the mounting plane; the flexible layered part being on at least part of the side surfaces.

18. The article of claim 17 in which each of the side surfaces extends in the direction approximately perpendicular to the mounting plane to an upper end, the upper ends of the side surfaces together lying approximately in an end plane; the solid part having, for each side surface, a respective stop surface that extends outward from the side surface's upper end approximately in the end plane; the flexible layered part being on substantially all of the side surfaces between the mounting surface and the stop surfaces.

19. The article of claim 17 in which at least one of the side surfaces has a side surface opening defined therein; for each side surface opening, the flexible layered part having a respective layered part opening defined in it over the side surface opening.

20. The article of claim 15 in which the flexible layered part is sufficiently thick between the first and second sides to prevent direct contact between the solid part and the recess surface.

21. A club head article that can be connected to a shaft to produce a golf club, the article comprising:

a front part that extends in a lateral direction and having first and second lateral ends and a forward surface extending between the first and second lateral ends; the front part including:

an upper bridge portion and a lower body portion behind the forward surface, each extending in the lateral direction between the first and second lateral ends; the forward surface having a lower part on the lower body portion, the lower part, in normal use, striking golf balls; and first and second end connections between the upper bridge and lower body portions at the first and second lateral ends, respectively and, between the first and second end connections, a less connected region that intersects a lateral center of mass of the club head article;

first and second connecting parts that connect to the lower body portion and extend approximately rearward from behind the first and second lateral ends of the forward surface;

a weight component connected to the first and second connecting parts at a distance from the forward surface; and a hosel that is connected to the upper bridge portion and that can be connected to a shaft.

22. The article of claim 21 in which an effective mass of the lower body portion is sufficiently greater than the upper bridge portion's mass and the first and second end connections are sufficiently large relative to any connection in the less connected region that the club head article has negligible twist about the lateral center of mass when, as a result of force received through the hosel, the forward surface's lower part strikes a golf ball at a position laterally displaced from the lateral center of mass; the effective mass of the lower body portion including the weight component's mass.

23. The article of claim 21 in which the forward surface imparts momentum to a golf ball most efficiently if it is moving in an optimal direction when it strikes the golf ball; the club head further comprising:

an arrow-like component extending approximately in the optimal direction from the weight component to the front part's lower body portion behind the forward surface; the arrow-like component being visible between the first and second connecting parts to a user swinging the golf club, pointing approximately in the optimal direction; and connection means for connecting the weight component and the arrow-like component; the connection means transferring negligible momentum from the weight component to the arrow-like component when the forward surface strikes a golf ball.

24. The article of claim 21 in which the weight component comprises:

a weight structure; and a laterally extending part extending between the first and second connecting parts and having a recess larger than the weight structure, the weight structure being removably mounted in the recess.

25. The article of claim 24 in which the weight structure comprises:

a solid part having a mounting surface that is disposed toward the laterally extending part when the weight structure is mounted in the recess; and a flexible layered part that has first and second opposite sides and that is on the solid part; the first side being on at least substantially all of the solid part's mounting surface; the second side being disposed toward the laterally extending part when the weight structure is mounted in the recess.

* * * * *